US009365957B2

(12) United States Patent
Galan Llongueras et al.

(10) Patent No.: US 9,365,957 B2
(45) Date of Patent: Jun. 14, 2016

(54) ULTRALIGHT FLAT-WEAVE FABRIC COMPRISING TWO WEFT DIRECTIONS

(71) Applicant: TWISTPERFECT, S.L., Barcelona (ES)

(72) Inventors: Jordi Galan Llongueras, Barcelona (ES); Albert Galan Llongueras, Barcelona (ES)

(73) Assignee: TWISTPERFECT, S.L., Barcelona (ES)

( * ) Notice: Subject to any disclaimer, the term of this patent is extended or adjusted under 35 U.S.C. 154(b) by 0 days.

(21) Appl. No.: 14/388,999

(22) PCT Filed: Mar. 26, 2013

(86) PCT No.: PCT/ES2013/070202

§ 371 (c)(1),
(2) Date: Sep. 29, 2014

(87) PCT Pub. No.: WO2013/144411

PCT Pub. Date: Oct. 3, 2013

(65) Prior Publication Data

US 2015/0083269 A1 Mar. 26, 2015

(30) Foreign Application Priority Data

Mar. 29, 2012 (ES) ..... 201200338

(51) Int. Cl.
*D03D 15/02* (2006.01)
*D03D 13/00* (2006.01)
(Continued)

(52) U.S. Cl.
CPC ..... *D03D 15/0088* (2013.01); *D03D 13/002* (2013.01); *D03D 13/008* (2013.01); *D10B 2101/12* (2013.01); *Y10T 442/3041* (2015.04)

(58) Field of Classification Search
CPC ..... D04C 1/06; D04C 1/02; D04C 1/00; D04C 3/00; D04C 1/12; D04C 3/08; D04C 3/40; D03D 15/0011; D03D 19/00; D03D 15/00; D03D 1/00; D03D 25/005; D03D 3/00; D03D 41/00; D03D 13/002; D03D 15/02; D03D 15/0088; D03D 15/0083; D03D 41/004; D03D 13/008; D03D 3/005; D03D 13/00; D03D 13/004; D03D 15/0077; D03D 15/0094; D04H 13/002; D04H 3/05; D04H 3/07; D04H 1/42
See application file for complete search history.

(56) References Cited

U.S. PATENT DOCUMENTS 4,015,637 A * 4/1977 Halton et al. ..... 139/11
4,191,218 A * 3/1980 Clark et al. ..... 139/383 R
(Continued)

FOREIGN PATENT DOCUMENTS

EP 0743386 11/1996
ES 2372411 1/2012
(Continued)

*Primary Examiner* — Bobby Muromoto, Jr.
(74) *Attorney, Agent, or Firm* — Sturm & Fix LLP

(57) ABSTRACT

An ultralight flat-weave fabric including more than one wefts and their directions that intersect with one another to form a particular angle in relation to the warp, and a warp. The weft and warp are supplied with fibers or fabrics having a cross-section in the form of a flat tape. In this way, it is possible to product a woven fabric in which two weft tapes having different directions are combined with the warp tape, such that stresses in six different directions are absorbed in a single fabric layer without multiple fabrics having to be overlapped. The woven fabric is completely covered, has a weight-to-surface area ratio of 2, and, as a result, is very light.

1 Claim, 3 Drawing Sheets

(51) Int. Cl.
*D03D 15/00* (2006.01)
*D03D 25/00* (2006.01)

(56) References Cited

U.S. PATENT DOCUMENTS

| | | | | |
|---|---|---|---|---|
| 4,284,021 | A * | 8/1981 | Kaye | 112/439 |
| 4,438,173 | A * | 3/1984 | Trost | 428/221 |
| 4,578,301 | A * | 3/1986 | Currie et al. | 428/109 |
| 5,435,352 | A * | 7/1995 | Yamamoto et al. | 139/11 |
| 5,711,960 | A * | 1/1998 | Shikinami | 424/426 |
| 5,924,459 | A * | 7/1999 | Evans | 139/11 |
| 6,086,968 | A * | 7/2000 | Horovitz | 428/36.1 |
| 8,440,276 | B2 * | 5/2013 | Rose et al. | 428/34.5 |
| 2002/0059963 | A1 * | 5/2002 | De Meyer et al. | 139/383 R |
| 2002/0124900 | A1 * | 9/2002 | Khokar | 139/11 |
| 2002/0161388 | A1 * | 10/2002 | Samuels et al. | 606/192 |
| 2004/0168738 | A1 * | 9/2004 | Bryn et al. | 139/383 R |
| 2005/0009621 | A1 * | 1/2005 | Matsumoto et al. | 473/316 |
| 2005/0176323 | A1 * | 8/2005 | Minato et al. | 442/185 |
| 2006/0073752 | A1 * | 4/2006 | Enzien et al. | 442/76 |
| 2006/0166577 | A1 * | 7/2006 | Rashed | 442/1 |
| 2007/0072697 | A1 * | 3/2007 | Matsumoto et al. | 473/316 |
| 2007/0281562 | A1 * | 12/2007 | Kohlman et al. | 442/32 |
| 2008/0257443 | A1 * | 10/2008 | Khokar | 139/443 |
| 2009/0202763 | A1 * | 8/2009 | Rose et al. | 428/36.1 |
| 2009/0211517 | A1 * | 8/2009 | Kato et al. | 117/200 |
| 2009/0211518 | A1 * | 8/2009 | Kato et al. | 117/206 |
| 2009/0314785 | A1 * | 12/2009 | Cronin et al. | 220/590 |
| 2012/0297967 | A1 * | 11/2012 | Backer et al. | 89/36.02 |
| 2013/0045346 | A1 * | 2/2013 | Lehmann et al. | 428/35.2 |
| 2013/0092281 | A1 * | 4/2013 | Sutton et al. | 139/384 R |
| 2013/0101787 | A1 * | 4/2013 | Bhatnagar et al. | 428/114 |
| 2013/0202844 | A1 * | 8/2013 | Tam et al. | 428/107 |
| 2014/0000749 | A1 * | 1/2014 | Khokar | 139/103 |
| 2014/0004296 | A1 * | 1/2014 | Khokar | 428/104 |
| 2014/0083553 | A1 * | 3/2014 | Khokar | 139/11 |
| 2014/0150634 | A1 * | 6/2014 | Liu et al. | 89/36.02 |
| 2014/0157974 | A1 * | 6/2014 | Cahuzac | 87/33 |

FOREIGN PATENT DOCUMENTS

| | | |
|---|---|---|
| GB | 1157526 | 7/1969 |
| GB | 2102035 | 1/1983 |

* cited by examiner

ULTRALIGHT FLAT-WEAVE FABRIC COMPRISING TWO WEFT DIRECTIONS

OBJECT OF THE INVENTION

The purpose of the invention patent application herein is to register an ultralight flat-weave fabric comprising: more than one weft direction and a warp wherein said weft and warp are supplied with fibres or woven fabrics having a cross-section in the form of a flat tape, and weaving characteristics as a result of the manufacturing process of said woven fabric.

BACKGROUND OF THE INVENTION

In the technical fabric sector, on the one hand there are a wide variety of woven fabrics made with weaving machines for flat-woven fabrics, wherein the warp and weft threads are formed by yarns or groups of filaments in the form of a yarn whose cross-section tends to be circular.

The complexity of the woven fabric in which a warp and weft are formed by rectangular cross-section tapes having parallel filaments is an area which can be explored, which in the future will result in multiple developments that improve the current technique of the woven fabrics made from tapes and the machines that make said woven fabrics. Document ES2372411T3 describes the fact that by replacing the threads of the traditional warps and wefts of the textile by flat tapes having a rectangular section, the machine for processing them is completely different.

There are not many precedents of machines that produce woven fabrics manufactured from flat tapes. Reference should also be made to the aforementioned document ES2372411T3 which describes a biaxial flat-weave fabric manufactured from tape-type parallel filaments wherein one weft can vary the angle formed in relation to the warp. These machines differ in their design of the looms for textile yarns due to the fact that when the tape is handled during the process, there is an additional component to be considered; the position of the tape must always be flat and not rotate, a component that is completely omitted from conventional textile looms as it is not necessary. Notable evidence is that a conventional loom for spinning yarn can never process tapes because of the parts it contains or because of the weaving process.

On the other hand, in the technical textile sector and due to the high performance currently provided by fibres such as carbon fibres, paramedic multifilaments, fibreglass etc., there is a need for fabrics referred to as ultralight fabrics, namely, the weight of the woven fabric is minimal in relation to its surface and when these types of high-performance fibres are used, the result is a woven fabric that has high mechanical properties and which is very lightweight. Therefore, to obtain such ultralight woven fabrics, the warp and weft yarns, which are two parallel multifilaments having high performance fibres, must first be processed in a cross-section which tends to be circular to a rectangular section having a very small thickness and a considerable width.

For example, a group of carbon fibres having a circular cross-section (though not regular) composed of 12,000 filaments, is previously transformed into a tape of parallel fibres 20 mm wide by 0.03 mm high. Said tape can be treated with binding elements to provide cohesion to its structure as a tape and can be handled as such.

When the yarn is turned into a flat tape where the geometric component of the width and surface of the tape appears, woven fabrics can be constructed wherein this component is also taken into account and can be related to and conditioned with other dimensional aspects of the woven fabric such as the angle of the weft relative to the warp and the distances between consecutive weft and warp tapes.

In respect of the construction of the woven fabrics, the biaxial tape fabrics absorb stresses in four directions in which both the weft and warp are oriented, and when said directions need to be increased, said woven fabric is overlapped with another biaxial woven fabric having different directions, although the weight component per unit of surface of the final packaged structure is compounded as a disadvantage.

DESCRIPTION OF THE INVENTION

The purpose of the present invention patent application is to provide an ultralight flat-weave fabric comprising: more than one weft direction that intersects with one another to form a particular angle in relation to the warp, and a warp wherein said weft and warp are supplied with fibres or fabrics having a cross-section in the form of a flat tape, and the characteristics of the loom resulting from the manufacturing process of said woven fabric that resolves the aforementioned drawbacks, further providing other additional advantages that will be apparent from the accompanying description below.

A resulting woven fabric in which tapes are processed both in warp and weft and the fabric, which is constructed in two weft directions, intersect at two angles, one positive and one negative, in relation to the direction of the warp, has a weight-to-surface area ratio of 2 in relation to the tape.

Using a tape having a particular width d and an initial angle A of a weft in relation to the warp, regarding the warp angle, the other parameters are determined in order to obtain a geometry of the woven fabric that is 100% covered on the surface, namely, there are no empty spaces, and whose weight-to-surface area ratio in relation to the tape is 2.

Other such parameters obtained are:

Angle B of the second weft in relation to the warp, the free space between two consecutive warp tapes and the first weft E1 and the free space between two consecutive tapes of the second weft E2

They are obtained by means of the following equations:

$$E1=d*\sin(A/2)$$

$$E2=(d-E1)/(2*\sin(A/2))$$

$$B=-(90-(A/2))$$

Where $0<A<90°$, $0<B<-90°$.

The advantages of the new woven fabric are:

That it is a woven fabric made with tapes in which two weft tapes having different directions are combined with the warp tape, such that stresses in six different directions are absorbed in a single fabric layer without multiple fabrics having to be overlapped.

That the angles A and B can be adjusted based on the required direction of the woven fabric.

That the woven fabric is completely covered and has a weight-to-surface area ratio of 2, namely, as they are tapes, they are ultralight.

When producing any combination of the woven fabric according to the present invention, there is a characteristic typical of the loom that processes said fabric when passing the wefts, and the shuttle that carries each of the wefts will have the characteristic that the section of said shuttle cannot exceed the space (z) created by the structure of the woven fabric and therefore the shuttle may pass through multiple closed spaces (z) that were created by the warp tapes intersecting with the tapes of the other weft, and that said spaces (z) are those which the fabric leaves free for said weft to be positioned such as width d.

As it is a fabric with a complex structure, it is evident that the affected variables for constructing the woven fabric A, B, d, E1, E2, support a dimensional tolerance of +−15% of the theoretical values disclosed.

Other characteristics and advantages of the woven fabric, object of the invention herein, will become apparent from the description of a preferred, although not exclusive embodiment, which is illustrated by way of non-limiting example in the drawings appended, in which:

DESCRIPTION OF A PREFERRED EMBODIMENT

Although there are many preferable combinations for the possible distribution of the woven fabric included within the present invention, some examples are outlined below:

The woven fabric is formed by the vertical tapes (1) that form the warp, in which the space between two consecutive tapes is E, and the weft tapes (2) and (3) which are positioned in two directions:

- Weft tapes (2) positioned at an angle A relative to the position of the warp tapes (1) with a space between two consecutive tapes E1
- Weft tapes (3) positioned at an angle −B relative to the position of the warp with a space between two consecutive tapes E2.

Example 1

Carbon fibre tape (1) 12K (12000 filaments) having a diameter d=20 mm wide and a weight-to-surface ratio of 36 g/m2.

Initial angle A between the weft and warp +60°

Figure 1:
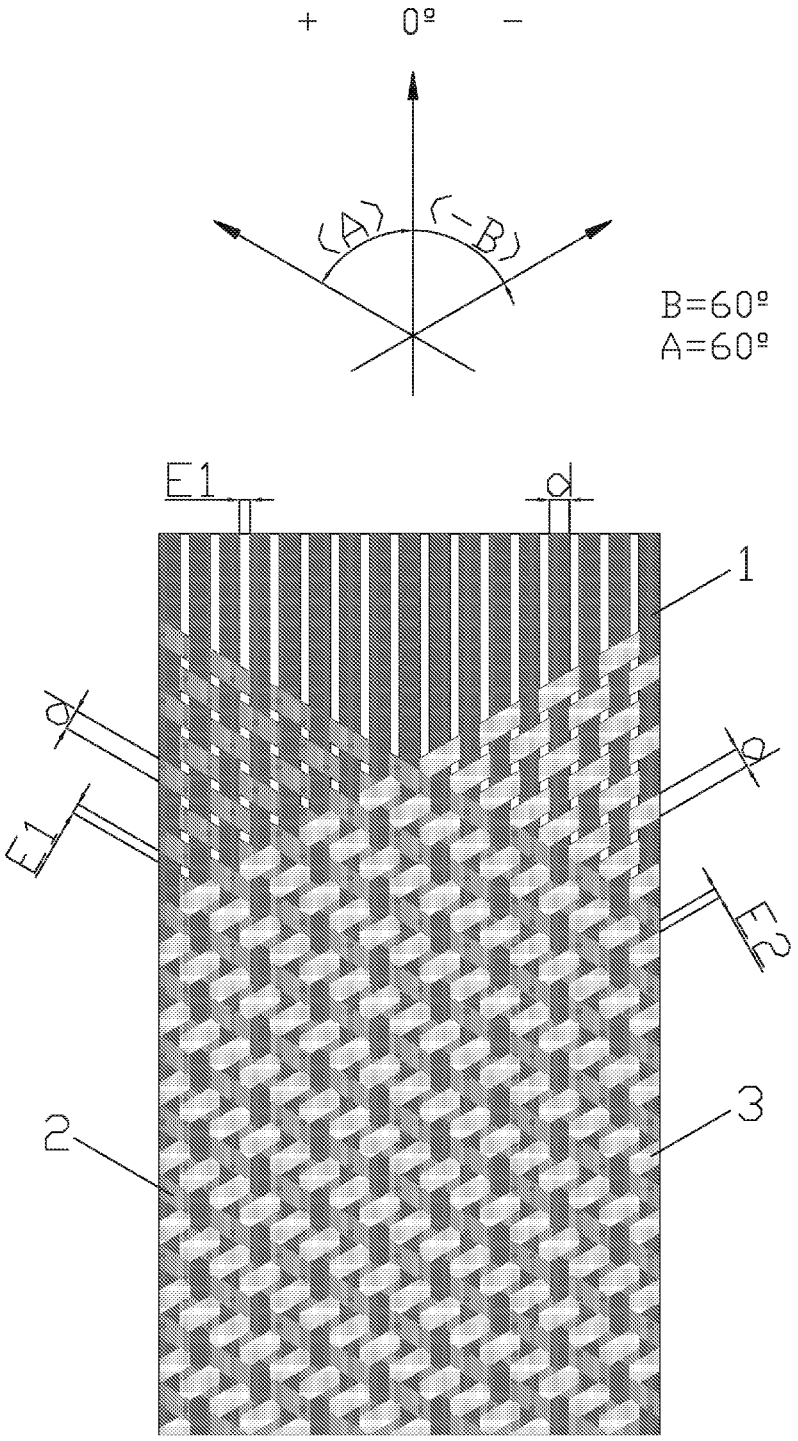
FIG. 1 is a view of the resulting woven fabric according to Example 1.

Parameters of resulting woven fabric (FIG. 1):

$$E1+d^*\sin(A/2)10\text{ mm}$$

$$E2=(d-E1)/(2^*\sin(A/2))10\text{ mm}$$

$$5B=-(90-(A/2))$$

Weight-to-surface ratio of the woven fabric=72 g/m2

Weight-to-surface ratio of the woven fabric compared to the tape=(72 g/m2)/(36 g/m2)=2

Example 2

Carbon fibre tape 12K (12000 filaments) having a 20 mm diameter width and a weight-to-surface ratio of 36 g/m2.

Initial angle A between the weft and warp +45°

Figure 2:
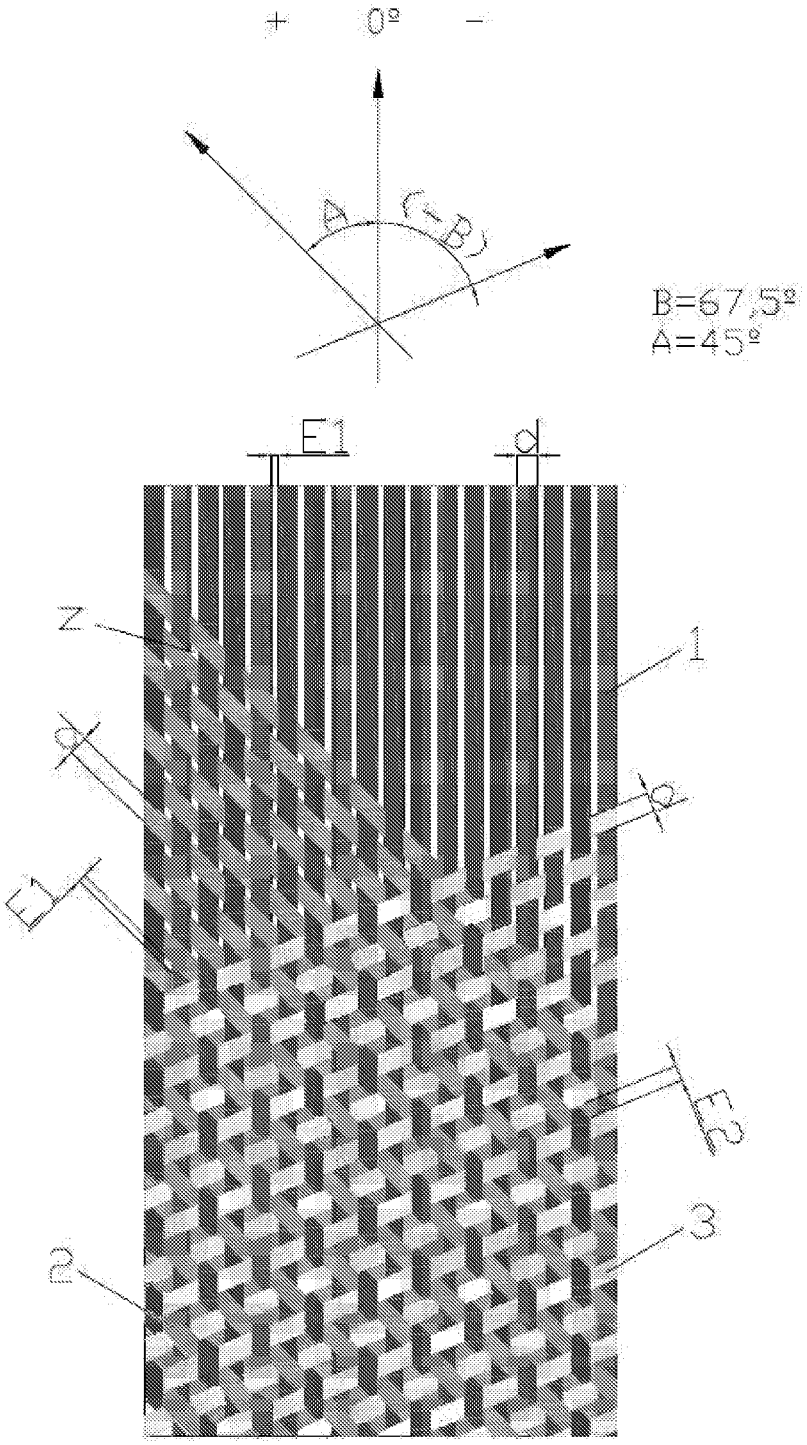
FIG. 2 is a view of the resulting woven fabric according to Example 2.

Parameters of resulting woven fabric (FIG. 2):

$$E1=d^*\sin(A/2)7.65\text{ mm}$$

$$E2=(d-E1)/(2^*\sin(A/2))16.13\text{ mm}$$

$$B=-(90-(A/2))-67.5°$$

Weight-to-surface ratio of the woven fabric=72 g/m2

Weight-to-surface ratio of the woven fabric compared to the tape=(72 g/m2)/(36 g/m2)=2

Example 3

Carbon fibre tape 12K (12000 filaments) having a 20 mm diameter width and a weight-to-surface ratio of 36 g/m2.

Initial angle A between the weft and warp+67.5°

Figure 3:
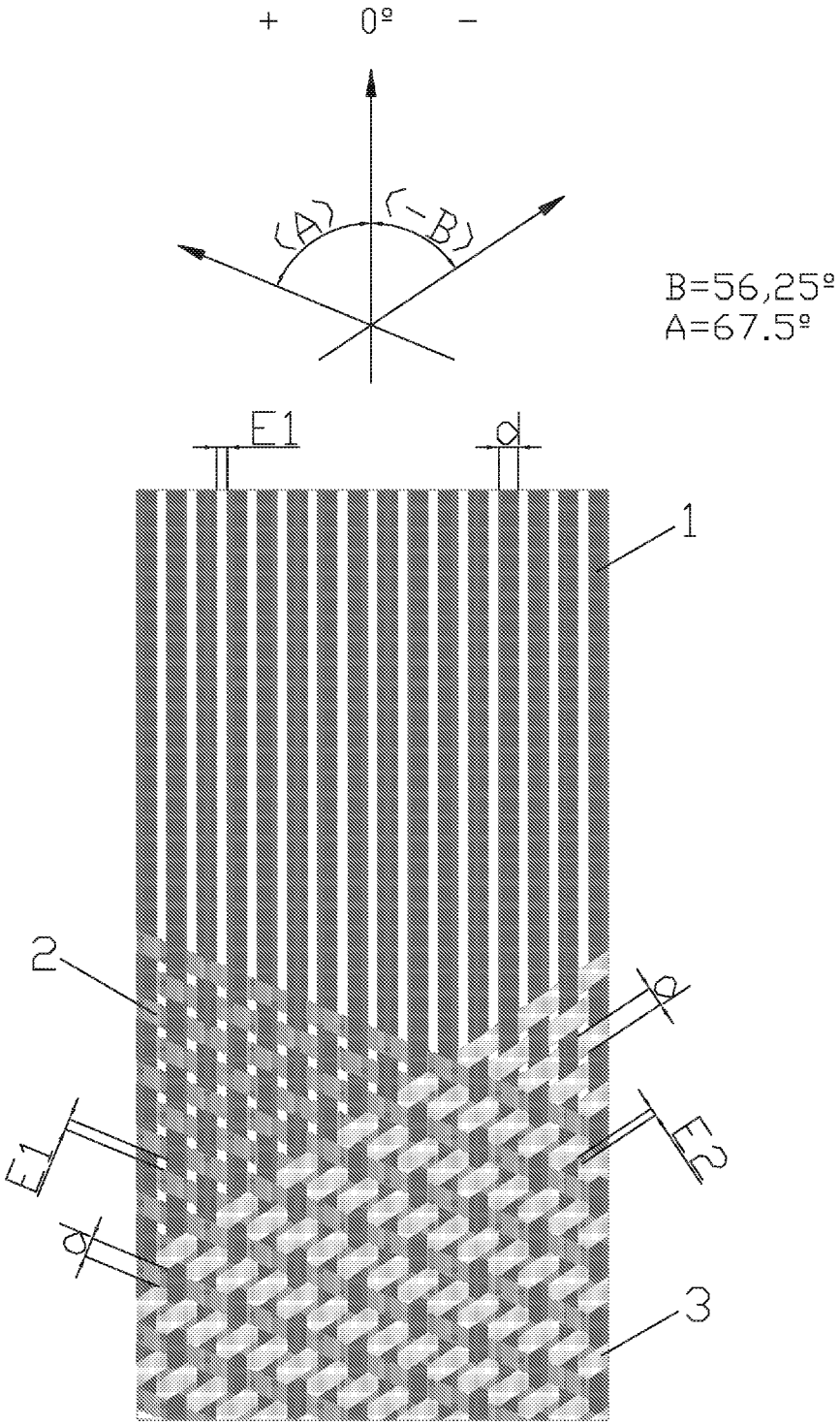
FIG. 3 is a view of the resulting woven fabric according to Example 3

Parameters of resulting woven fabric (FIG. 3):

$$E1=d^*\sin(A/2)11.11\text{ mm}$$

$$E2=(d-E1)/(2^*\sin(A/2))=8\text{ mm}$$

$$B=-(90-(A/2))-56.5°$$

Weight-to-surface ratio of the woven fabric=72 g/m2

Weight-to-surface ratio of the woven fabric compared to the tape=(72 g/m2)/(36 g/m2)=2

If combining tapes made of different materials, when we refer to the mass/surface ratio of the tape, this must be the result of the arithmetic average of the different mixed mass/surface values.

For example, we can use Carbon fibre tape 12K (12000 filaments) having a width of 40 mm and the mass/surface ratio of the tape being 18 g/m2, the end result of the woven fabric will be a ratio between tape and woven fabric also having a value of two, namely, 18*2 36 g/m2 in the woven fabric, object of the present invention.

The details, shapes and dimensions and other accessory elements as well as the materials used in the manufacture of the invention may be conveniently replaced by others which are technically equivalent and do not depart from the essential nature of the invention or from the scope defined by the claims provided hereinafter.

The invention claimed is:

1. Ultralight monolayer multiaxial woven fabric, having one wrap and two wefts cross-linked to each other comprising each of the wefts that intersect with one another at +A° and −B° in relation to the warp are parallel multifilaments, a cross-section of which is largely flat serving as a tape having a "d" width, wherein, the initial angle A and the width of the "d" tape determine the geometry of the woven fabric such that the following equations are fulfilled:

$$E1=d^*\sin(A/2)$$

$$E2=(d-E1)/(2^*\sin(A/2))$$

$$B=-(90-(A/2)),$$

E1 corresponding to the empty space between two adjacent weft tapes and positioned at an angle A relative to the position of the warp tapes;

E2 being the empty space between two adjacent weft tapes and positioned at an angle B relative to the position of the warp tapes; and B defined as the angle between the direction of the weft tapes and the direction of the warp tapes, in which there is a woven fabric that has no uncovered gaps or hollows between the warp and the wefts, and the value of the angles A and B between the wefts in relation to the warp being O°<A<−90° and O°<B<−90°.

* * * * *